US005649508A

United States Patent [19]

Rost et al.

[11] Patent Number: 5,649,508

[45] Date of Patent: Jul. 22, 1997

[54] LIQUID DISPENSING SIDE HANDLE APPARATUS AND METHOD

[75] Inventors: Richard J. Rost, Bellevue; Jeffrey P. Fay, Edmonds, both of Wash.

[73] Assignees: Wallace A. Rost; Elaine L. Rost, both of Bellevue, Wash.; Robert W. Rost, Grand Forks, N. Dak.; James S. Rost, Bellevue, Wash.

[21] Appl. No.: 389,352

[22] Filed: Feb. 16, 1995

[51] Int. Cl.[6] ..... B67D 5/06

[52] U.S. Cl. ..... 222/191; 222/192; 451/446; 15/97.1; 15/29; 15/31

[58] Field of Search ..... 15/97.1, 28, 31, 15/53.1, 97.2, 23, 50.1, 51, 29, 50.2, 50.3, 98; 222/191, 192, 383.1, 321.7, 321.9; 451/449, 450, 446, 442, 259

[56] References Cited

U.S. PATENT DOCUMENTS

| | | | |
|---|---|---|---|
| 1,186,433 | 6/1916 | Peralta et al. | 15/29 |
| 1,952,910 | 3/1934 | Decker | 15/29 |
| 2,161,988 | 6/1939 | Warr et al. | 221/67 |
| 2,602,946 | 7/1952 | Gilbert | 15/97 |
| 3,104,783 | 9/1963 | Hall | 15/29 |
| 3,166,772 | 1/1965 | Bodine, Jr. | 15/50.1 |
| 3,204,272 | 9/1965 | Greee et al. | 222/191 |
| 3,829,019 | 8/1974 | Petsch | 15/50.1 |
| 4,678,922 | 7/1987 | Leininger | 15/28 |
| 5,231,727 | 8/1993 | Armbruster | 15/97.1 |

*Primary Examiner*—Gary K. Graham
*Attorney, Agent, or Firm*—William G. Forster

[57] ABSTRACT

A receiving side handle is provided for receiving and supporting a liquid rubbing compound dispenser from a hand-held buffing machine of the type having a threaded side handle bore. The receiving side handle is interchangeable with original equipment threaded side handles. In this way, the receiving side handle retrofits hand-held buffing machines to enable a buffing machine operator to dispense liquid rubbing compound on a surface while maintaining an uninterrupted grip on a retrofitted buffing machine. The receiving side handle includes a handle frame attached to a threaded rod for mounting the handle frame to a hand-held buffing machine. In addition, the receiving side handle includes a coupling structure defined by a portion of the handle frame, the coupling structure being provided for receiving and coupling a liquid compound dispenser to the handle frame.

5 Claims, 3 Drawing Sheets

LIQUID DISPENSING SIDE HANDLE APPARATUS AND METHOD

BACKGROUND

This invention relates generally to hand-held buffing machines of the type that employ a removable side handle, and more particularly to an interchangeable replacement receiving side handle for use with such buffing machines. The invention further relates to a method of buffing a surface that enables a buffing machine operator to simultaneously dispense and apply liquid rubbing compound on a surface while maintaining an uninterrupted grip on a continuously operated buffing machine.

Hand-held buffing machines have been used for polishing and buffing painted automobile surfaces for a number of years. Moreover, automobile detailing and restoring have recently gained increased popularity and acceptance by automobile enthusiasts. For this purpose, liquid rubbing compounds are employed by auto painters and detailers alike to speed the buffing process, and obtain a high polished, lustrous shine on a painted automobile surface.

Typically, the buffing process includes a number of steps. First, the buffing machine operator or automobile detailer applies a liquid rubbing compound to an automobile surface prior to buffing. A detailer usually accomplishes this by physically grasping a compound dispenser that incorporates a hand or finger operated pump mechanism. The pump mechanism being connected to a container of liquid rubbing compound for distribution of the same. By hand or finger activation of the pump mechanism, the detailer dispenses liquid rubbing compound on a surface. Next, the detailer places the dispenser aside, picks up the buffing machine, and begins or continues the buffing process.

Then, as additional compound is required, the detailer must stop buffing, and release his or her grip on the buffing machine so that he/she can pick up the dispenser. Next, the detailer must apply additional compound by the procedure noted above, and then pick up the buffing machine and resume buffing. Because a detailer must dispense additional compound many times, to many areas of the automobile, the above noted process of interrupting the buffing procedure to apply additional compound occurs repeatedly. In addition, the detailer must occasionally use a different grade of liquid compound during the final stages of polishing to obtain the best shine. Accordingly, if a detailer were able to apply liquid rubbing compounds without removing his or her hands from the buffing machine, except when a change in compound is required, the buffing procedure could be performed considerably faster, thereby increasing efficiency and productivity of the detailer.

One invention that made improvements with regard to this problem is U.S. Pat. No. 2,602,946 issued to N. S. Gilbert in 1952. In the '946 invention, Gilbert provides a hand actuated disc polishing machine for polishing surfaces. The machine includes a pair of hand grip portions with a control switch accessible to a finger of one hand and a fluid release plunger accessible to the finger of another hand when both hands are engaging the hand grip portions of the machine. Further, the '946 invention employs a pad having a centrally located aperture for the discharge of liquid therethrough. The liquid is supplied from a cylinder permanently mounted on the buffing machine.

Because the '946 design incorporates a permanently mounted cylinder for storage of liquid rubbing compound, the cylinder must be emptied and cleaned when a change to a different grade rubbing compound is required during the buffing procedure. Accordingly, the time required to change from one grade compound to another is cumbersome and lengthy. In addition, the '946 buffing machine requires special buffing pads having a central aperture for the dispensing of liquid compound. As such, common, inexpensive buffing pads cannot be utilized. Moreover, modern buffing machines of the type having a removable side handle for gripping, cannot be retrofitted to employ the '946 method of dispensing liquid compounds which requires dispensing the same through a centrally located liquid dispenser.

Accordingly, a need exists for an apparatus that can be employed to retrofit modern buffing machines, of the type having a removable side handle, to enable a buffing machine operator to simultaneously apply liquid rubbing compound to a surface and maintain an uninterrupted grip on the buffing machine while continuously operating the same.

SUMMARY

One object of the present invention to quicken the process of buffing automobile surfaces thereby increasing the productivity of automobile painters and detailers.

A second object of the present invention is to enable a buffing machine operator to operate and grip a buffing machine with two hands, while simultaneously dispensing a liquid buffing compound onto a surface.

A third object is to enable an automobile detailer to easily change liquid rubbing compounds without having to change buffing machines or clean compound storage containers.

Another object is to enable a detailer to determine the actual amount of liquid rubbing compound applied to a surface while maintaining and uninterrupted grip on a continuously operated buffing machine.

Yet another object is to have a buffing machine operator maintain an uninterrupted grip on the buffing machine while dispensing liquid buffing compounds.

A further object is to enable a buffing machine operator to dispense liquid rubbing compounds on a vertical surface while maintaining an uninterrupted grip on the buffing machine.

Still another object is to provide an after-market, retrofit apparatus for buffing machines of the type having a removable side handle, that facilitates the dispensing of liquid rubbing compounds.

The invention is a receiving side handle designed and constructed to receive and support a liquid rubbing compound dispenser. The receiving side handle receives and interconnects with a liquid rubbing compound dispenser to form a complete side handle assembly. The receiving side handle is adapted for use with hand-held buffing equipment of the type that employ a removable threaded side handle that threadably engages a threaded side handle bore. The receiving side handle is intended for buffing machine operators and automobile detailers alike to replace the original equipment side handle supplied with such buffing equipment.

The receiving side handle is interchangeable with original equipment threaded side handles. In this way, the receiving side handle can retrofit a hand-held buffing machine to enable a buffing machine operator to dispense liquid rubbing compound on a surface while maintaining an uninterrupted grip on the receiving side handle.

The receiving side handle includes a handle frame attached to a threaded rod for mounting the handle frame to the threaded side handle bore of a hand-held buffing machine. In this way, the handle frame can be gripped by the hand of a buffing machine operator during the buffing procedure. In addition, the receiving side handle includes a coupling structure defined by a portion of the handle frame. The coupling structure is provided to receive and support a dispenser of liquid rubbing compounds. With this configuration, a buffing machine operator's hand is disposed adjacent to the liquid compound dispenser. As a result, a buffing machine operator can actuate the compound dispenser to dispense liquid rubbing compound on a surface without interrupting or releasing the grip on the side handle.

In accordance with another aspect of the invention, a method of buffing a surface while simultaneously dispensing and applying liquid rubbing compound on the surface is disclosed. The method comprises providing a buffing machine of the type having a threaded side handle bore for receiving a threaded side handle. A handle frame is engaged with the threaded side handle bore of the buffing machine, and a liquid compound dispenser is coupled to the handle frame. Additionally, a buffing machine operator actuates the liquid compound dispenser to dispense liquid rubbing compound on a surface while simultaneously operating the buffing machine.

The foregoing and other objects and advantages of the present invention will become readily apparent to those skilled in this art from the following detailed description which proceeds with reference to the accompanying drawings. Only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENT

Figure 1:
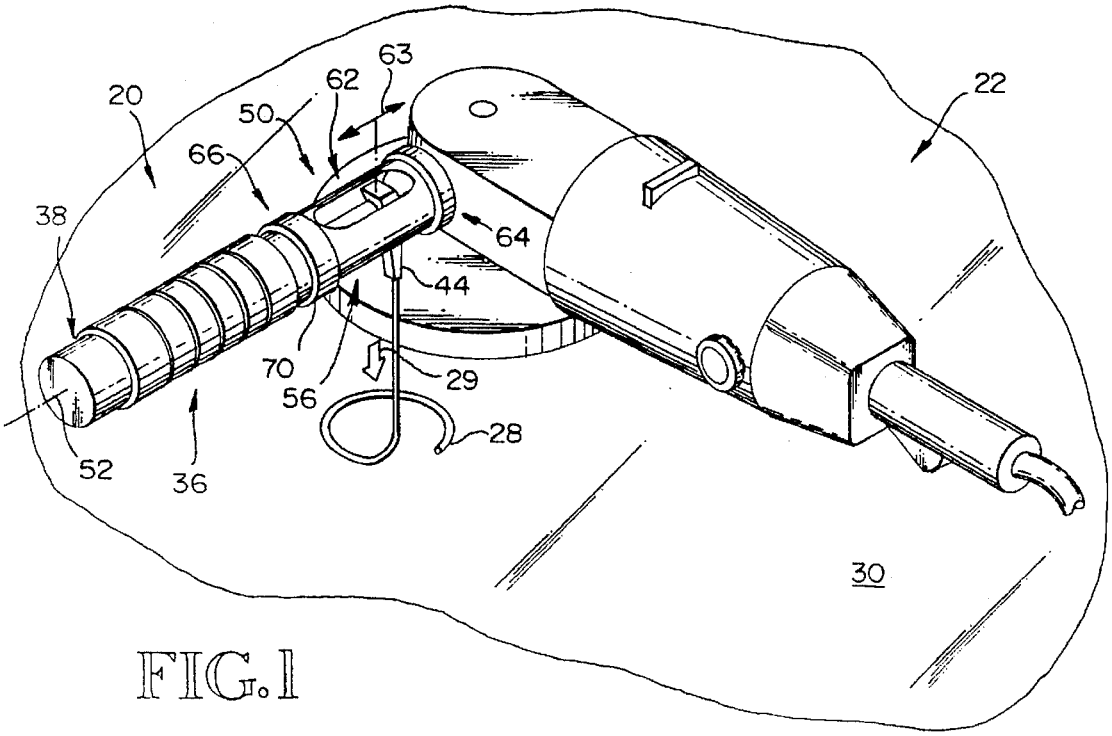
FIG. 1 is a perspective view of a liquid dispensing side handle assembly threadably mounted to a hand-held buffing machine, wherein the liquid compound dispenser is being activated, as is typically done by a finger (not shown) of a buffing machine operator, to dispense liquid rubbing compound onto a surface.
Figure 2:
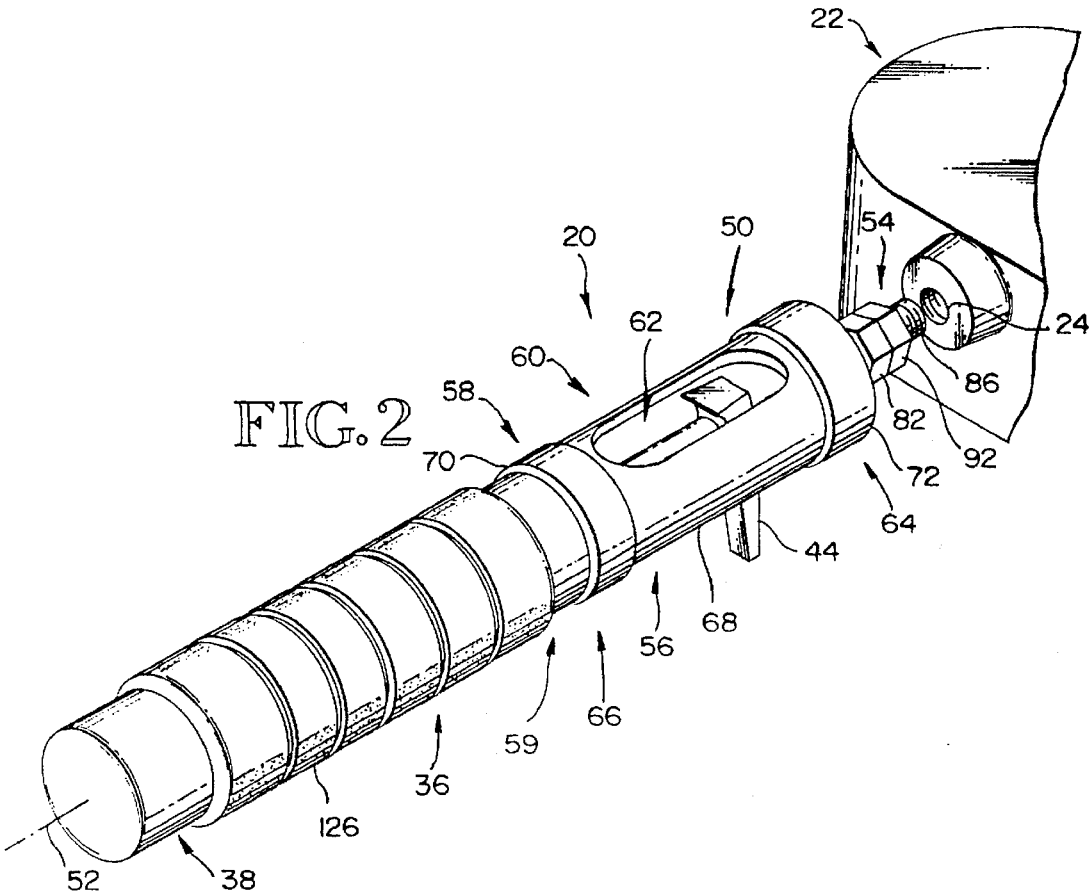
FIG. 2 is a perspective view of a liquid dispensing side handle assembly prior to being threadably mounted to a threaded side handle bore of a hand-held buffing machine.

Indicated generally at 20 is a liquid dispensing side handle assembly in accordance with the present invention. As best seen in FIG. 1, the liquid dispensing side handle assembly 20, hereinafter referred to as the "side handle assembly 20", is threadably mounted to a buffing machine 22 of the type having a threaded side handle bore 24. The side handle assembly 20 is provided to enable a buffing machine operator (not shown) to apply a liquid rubbing compound 28 to a surface 30 while maintaining an uninterrupted grip on a continuously operated buffing machine 22. It should be appreciated that the flow indicating arrow 29, in FIG. 1, indicates the direction of flow of liquid rubbing compound 28 as it is being dispensed onto a surface 30.

As will be more full explained below, a side handle assembly 20 comprises a number of separate components that are assembled to form an integrated side handle grip that dispenses liquid rubbing compound. The side handle assembly 20 is provided as a replacement for original equipment side handles found on most modern hand-held buffing equipment. Accordingly, the components of a side handle assembly 20 are sized to be gripped by an operator's hand (not shown). In this way, the side handle assembly 20 is interchangeable with original equipment side handles (not shown) for replacement thereof.

Figure 4:
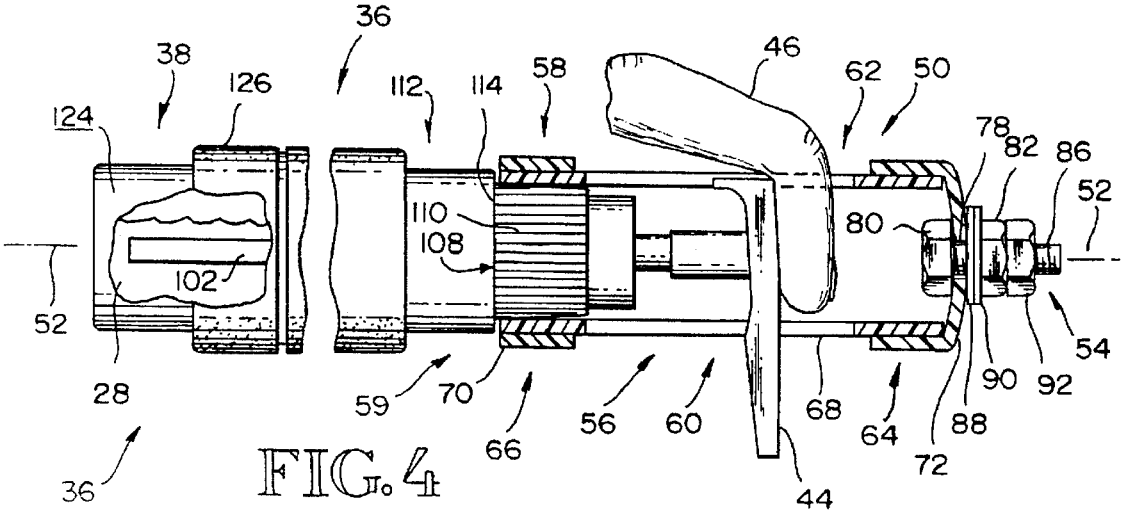
FIG. 4 is a fragmentary side elevation of a side handle assembly that includes a liquid compound dispenser received and supported by a receiving side handle, wherein the handle frame included therein is illustrated in cross section, and a buffing machine operator's finger is shown activating the pump mechanism.

To apply a liquid rubbing compound 28 to a surface 30, the side handle assembly 20 includes a liquid compound dispenser 36. The liquid compound dispenser 36 comprises a reservoir 38 for the storage of liquid rubbing compounds 28. To dispense the same onto a surface 30, the liquid compound dispenser 36 further comprises a finger operated piston type pump mechanism 40 that is in communication with the reservoir 38. The pump mechanism 40 further comprises a discharge nozzle 44 for directing the liquid rubbing compound 28. In this way, a buffing machine operator can dispense a liquid rubbing compound 28 by actuating the pump mechanism 40 with a finger 46 as illustrated in FIG. 4. Accordingly, a buffing machine operator can dispense liquid rubbing compound 28 onto a surface 30 while he/she maintains an uninterrupted grip on a continuously operated buffing machine 22.

Considering now in more detail the structure of the components from which a side handle assembly 20 is constructed, a receiving side handle 50 is provided. The receiving side handle 50 is so provided to replace an original equipment side handle (not shown) that is typically supplied as original equipment with hand-held buffing machines 22 of the type that incorporate a removable threaded side handle. To allow installation of a receiving side handle 50, the original equipment side handle is removed from the threaded side handle bore 24 of a buffing machine 22.

In the preferred embodiment, the receiving side handle 50 extends outward from the buffing machine 22, similar to the original equipment side handle, along a side handle axis 52. The side handle axis 52 is coaxially disposed in relation to the axis defined by the threaded side handle bore 24. As will be discussed more fully below, a threaded rod 54 is employed to mount the receiving side handle 50 to the threaded side handle bore 24 of the buffing machine 22. The receiving side handle 50 is configured to receive and grasp a liquid compound dispenser 36. In this way, the receiving side handle 50 connects and links the liquid compound dispenser 36 to the buffing machine 22 for dispensing liquid rubbing compound 28 during the buffing procedure.

Figure 7:
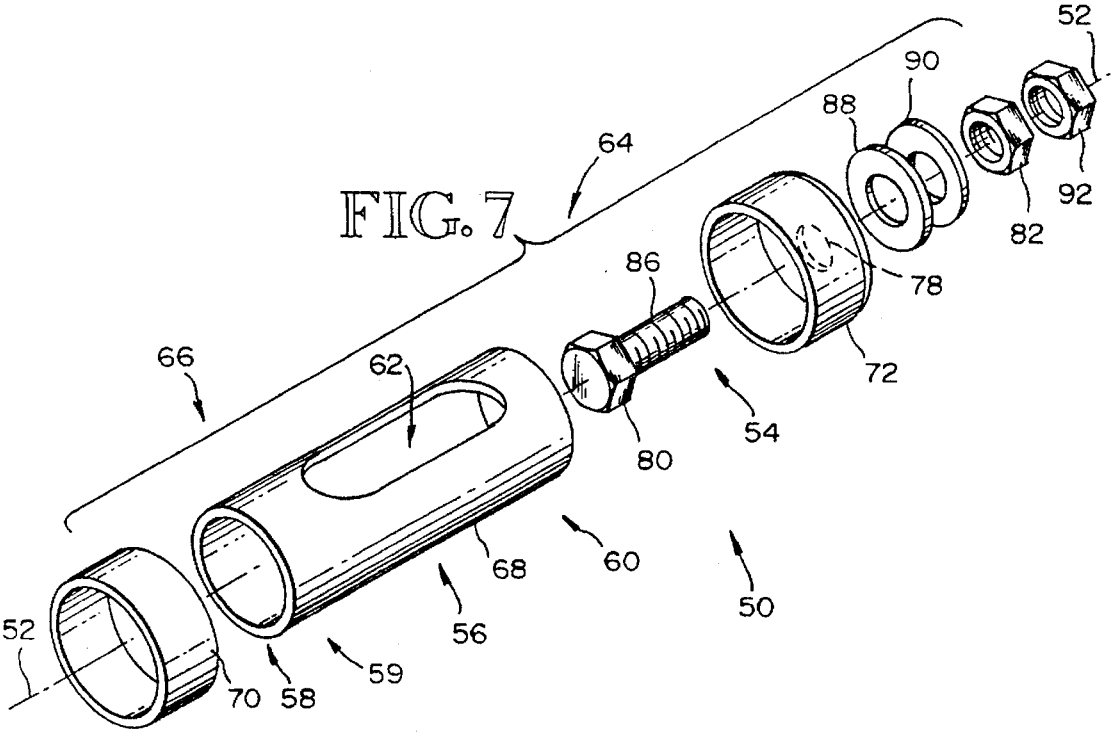
FIG. 7 is an exploded perspective view of a receiving side handle that includes a handle frame and means for releasably engaging a threaded side handle bore of a hand-held buffing machine.

Turning now to FIG. 7, an exploded perspective view of a receiving side handle 50 is illustrated. In the preferred embodiment, the components of the receiving side handle 50 are primarily constructed of plastic plumbing fittings, except for some miscellaneous metal parts that include a threaded rod 54 constructed from a ½ inch diameter hex head steel bolt. The ½ inch diameter bolt is furnished to provide means for releasably engaging the threaded side handle bore 24 of a buffing machine 22. A primary component of the receiving side handle 50 is the handle frame 56. As will be more fully explained below, a portion of the handle frame 56 defines a coupling structure 58, adapted to receive and support a liquid compound dispenser 36.

More specifically, the handle frame 56 is constructed of rigid material, and could be furnished in a number of different acceptable configurations. However, in the preferred embodiment, the handle frame 56 comprises an elongate tubular shank 60, constructed from standard one inch diameter round PVC pipe side wall, i.e., the side wall of the tubular shank 60. Being tubular in shape, the tubular shank 60 defines a side handle axis 52 that extends therethrough.

Further, the tubular shank 60 includes an opening 62 formed completely through the side wall thereof about an axis disposed transverse to the side handle axis 52, i.e., perpendicular to the side handle axis 52. The opening 62 is formed by removing two opposing portions of the PVC side wall. Thus, the opening comprises two opposing holes of approximately equal size and shape, located on opposite sides of the tubular shank 60. Also, in the preferred embodiment, the removed portions are slightly elongated in a direction parallel to the side handle axis 52, thereby creating an elongated opening.

As will be more fully discussed below, portions of the discharge nozzle 44 of a liquid compound dispenser 36 are received through the opening 62. Accordingly, as seen in FIG. 4, the removed side wall portions that form the opening 62 are sized and shaped to permit a finger 46 to be inserted to actuate a pump mechanism 40. To put it differently, the pump mechanism 40 includes a discharge nozzle 44 that extends outward from the tubular shank 60 in a direction opposite the finger 46. To operate the pump mechanism 40, the finger 46 urges the discharge nozzle 44 in a direction indicated by arrow 63 in FIG. 1, parallel to the side handle axis 52. Accordingly, the opening 62 is formed to provide enough room for a finger 46 to actuate the pump mechanism 40.

The tubular shank 60 includes a first end portion 64, an opposing second end portion 66, and a tubular shank body 68 integrally disposed therebetween, linking the first end portion 64 to the opposing second end portion 66. Thus, the opening 62 is formed through the tubular shank body 68. As previously noted, a coupling structure 58 is defined by a portion of the handle frame 56.

Figure 3:
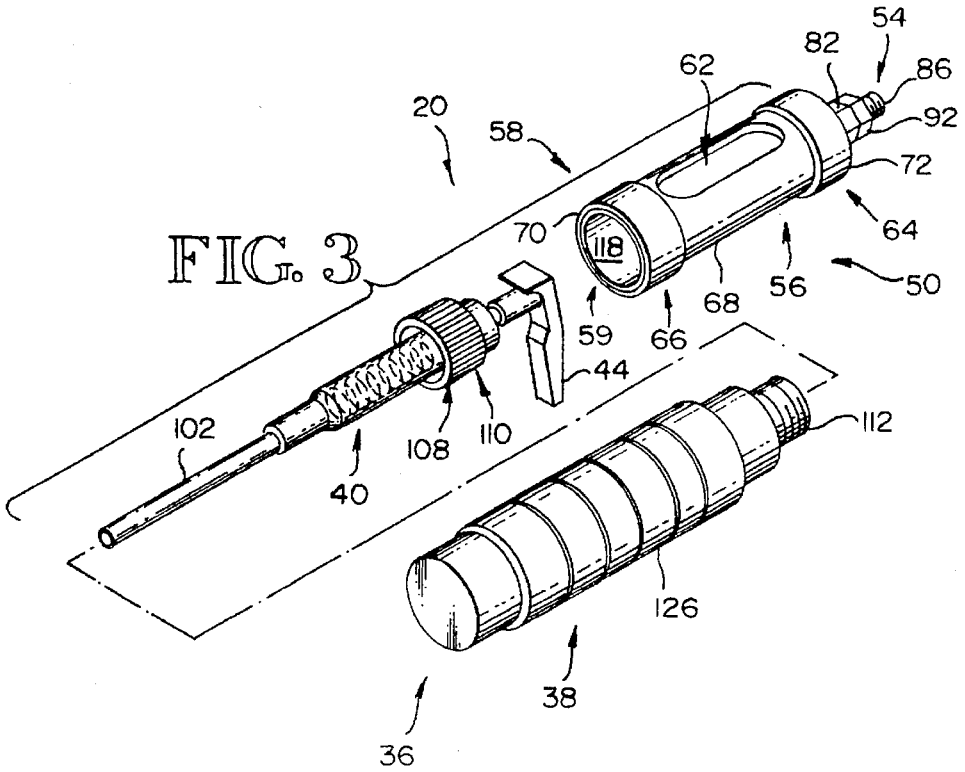
FIG. 3 is an exploded perspective view of a liquid dispensing side handle assembly including a handle frame, and a liquid compound dispenser that includes a pump mechanism and a reservoir having a resilient gripping band wrapped around the same.

A coupling structure 58 could be constructed in many different shapes and configurations, and is primarily dictated by the shape of that portion of the liquid pump dispenser 36 that is coupled thereto. For example, a coupling structure 58 could comprise a "U" shaped clip, or a "C" shaped clip that would partially surround and grip a portion of a liquid pump dispenser 36 (these configurations are not illustrated). However, in the preferred embodiment, the coupling structure 58 is a cylindrical like structure referred to as a receiving sleeve 59. The receiving sleeve 59 comprises a portion of the round PVC pipe, i.e., the receiving sleeve 59 is defined by the second end portion 66 of the tubular shank 60. The second end portion 66 being that portion of tubular shank 60 that extends beyond the opening 62 to receive a liquid compound dispenser 36 as illustrated in FIGS. 3–4. The receiving sleeve 59 is strengthened by the addition of a reinforcing ring 70 which prevents cracking of the PVC material when a liquid compound dispenser 36 is coupled thereto. The reinforcing ring 70 is made from PVC material of the same shape as the second end portion 66, and is sized to fit closely and concentrically over the same. The reinforcing ring 70 is bonded to the second end portion 66 with common PVC glue.

As previously noted, a threaded rod 54 is employed to mount the receiving side handle 50 to the threaded side handle bore 24 of a buffing machine 22. For this purpose, a connection head 72 is provided for attachment to the handle frame 56. The connection head 72 is made from a common PVC end cap plumbing fitting of the size and type to fit over, and cap, a one inch diameter PVC pipe. More specifically, the connection head 72 is attached to the first end portion 64 of the tubular shank 60 of the handle frame 56. The connection head 72 includes a bore 78 coaxially disposed through the connection head 72. The bore 78 is so provided to accommodate a threaded rod 54 fitted therethrough as illustrated in FIG. 4. In this way, the handle frame 56 can be attached to the connection head 72 which is threadably connected to a threaded side handle bore 24 of a buffing machine 22.

In the preferred embodiment, a common ½ inch diameter bolt is utilized for the threaded rod 54. The bolt includes a hex head 80 attached to a threaded rod 54. The threaded rod 54 portion of the bolt is inserted through a coaxial bore 78 provided through the connection head 72 as illustrated in FIG. 4. To secure the threaded rod 54 in proper position, the connection head 72 is disposed between the hex head 80 and an opposing tightening nut 82. Thus, the threaded rod 54 extends through the coaxial hole 78, and is secured thereto by a tightening nut 82 that threadably engages the threaded rod 54.

Similarly, a second nut 92, disposed adjacent the tightening nut 82 on the threaded rod 54 is provided. The second nut 92 is so disposed to be urged against a buffing machine housing 94 thereby securing the receiving side handle 50 against turning once the threaded rod 54 engages the threaded side handle bore 24. In this way, the opening 62 can be rotated to a predetermined position, and maintained in that position by urging the second nut 92 against a portion of a buffing machine 22.

Beyond this, the preferred embodiment includes a pair of washers 88–90 disposed between the tightening nut 82 and the connection head 72. The washers are provided to spread the pressure created when the tightening nut 82 is urged toward the hex head 80 to firmly secure the threaded rod 54 to the connection head 72. In this way, the connection head 72 is protected from the tightening nut 82.

Additionally, because the connection head 72 and the reinforcing ring 70 are each sized to closely fit over similarly sized end portions of the tubular shank 60, one standard "end cap" plumbing fitting can provide both the connection head 72 and the reinforcing ring 70. For example, a PVC end cap is cut into two pieces, by any ordinary method. The cut in made perpendicular, i.e., normal to its axis, and splits the end cap approximately in half. The resulting two pieces form a reinforcing ring 70, and a connection head 72. The reinforcing ring 70 is fitted over the tubular shank 60, around the second end portion 66 and welded thereto with PVC glue. Similarly, the connection head 72 is fitted over the opposite end of the tubular shank 60, i.e., the first end portion 64, and welded thereto with PVC glue.

Directing attention to FIGS. 2–6, a liquid compound dispenser 36 is illustrated. For the purposes of this invention, the same is constructed of common, easily obtained components. For example, the pump mechanism 40 is an ordinary restaurant-type, finger actuated, dispensing pump typically employed for dispensing ketchup, mustard or other condiments. Similarly, the reservoir 38 is a standard commercially available bottle having a threaded neck 112 that defines a reservoir shoulder 114. Such bottles come in many sizes, however in the preferred embodiment, the bottle is of a size suitable for gripping.

Included in the pump mechanism 40 is an inlet tube 102 for collecting liquid rubbing compound 28, a threaded seal cap 108 for mounting the pump mechanism 40 to a reservoir 38, and a discharge nozzle 44 for directing the liquid rubbing compound 28 onto a surface 30. To supply liquid rubbing compound 28, the reservoir 38 is filled with the same through the neck 112, wherein the inlet tube 102 is disposed to be in communication with the reservoir 38. To contain the liquid rubbing compound 28 in the reservoir 38, the seal cap 108 is sealingly connected to the neck 112. The seal cap 108 is so connected by threadably engaging the seal cap 108 to the neck 112. As best seen in FIGS. 3–6, the seal cap 108 is shaped to define a slightly tapered cylindrical outer surface 110. Further, the seal cap 108 is disposed between the discharge nozzle 44 and the reservoir 38. The seal cap 108 is provided to sealingly connect the pump mechanism 40 to the reservoir 38.

Turning now to FIG. 3, a cylindrical inner gripping surface 118 is defined by the receiving sleeve 59. The cylindrical shape and size of the gripping surface 118 is adapted to receive a portion of the liquid compound dispenser 36. More specifically, the liquid compound dispenser 36 is coupled to the receiving side handle 50 by urging the seal cap 108 into the receiving sleeve 59. In this way, the outer surface 110 of the seal cap 108 engages the inner gripping surface 118 to firmly couple the liquid compound dispenser 36 to the receiving side handle 50 wherein the resulting combination is a complete side handle assembly 20. Because the outer surface 110 of the seal cap 108 is tapered, the outer surface 110 is increasingly compressed against the inner gripping surface 118 as the seal cap 108 advances into the receiving sleeve 59 of the coupling structure 58.

Figure 5:
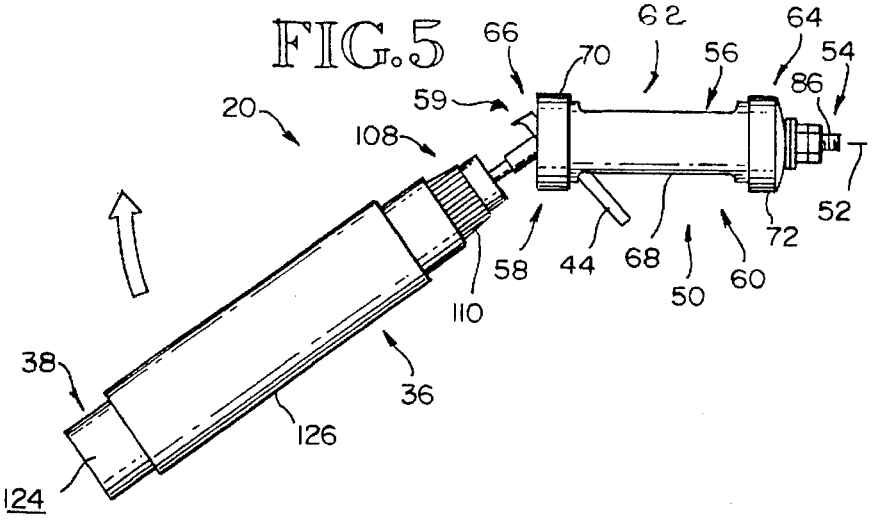
FIG. 5 is a side elevation of a liquid dispensing side handle assembly with the liquid compound dispenser being inserted into a handle frame of a receiving side handle as indicated by the arrow, wherein the discharge nozzle is being guided through an opening in the handle frame.
Figure 6:
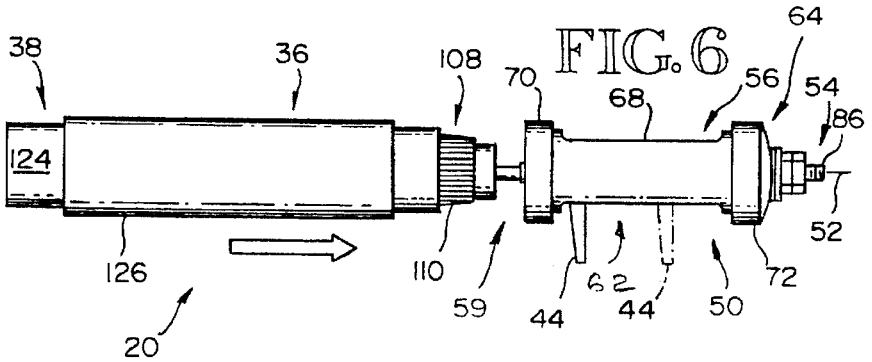
FIG. 6 is a side elevation of a liquid dispensing side handle assembly with the liquid compound dispenser being inserted into its operating position as indicated by the arrow.

Turning now to the drawing sequence FIGS. 5–6, a liquid compound dispenser 36 is being advanced into, and received by a receiving side handle 50. FIG. 5 illustrates a discharge nozzle 44 being guided through a receiving sleeve 59, and extending through the opening 62 of the handle frame 56. It should be appreciated that some commercially supplied pump mechanisms include a nozzle that requires trimming in order to so extend through an opening 62. FIG. 6 illustrates the final step of aligning the liquid compound dispenser 36 along the side handle axis 52 so that it can be advanced into its final position, coupled to the receiving side handle 50. It should be noted that the liquid compound dispenser is advanced to a position where the reservoir shoulder 114 is adjacent the coupling structure 58.

Finally, a resilient gripping band 126 is provided in order to improve the grip of a buffing machine operator, i.e., so that the operator can maintain a firm grip on the reservoir 38 as well as the receiving side handle 50. Briefly, an outer surface 124 is defined the reservoir 38. The outer surface 124 is finally covered by an appropriately sized, close fitting resilient gripping band 126.

As can be seen from the foregoing, a buffing machine operator can utilize a plurality of liquid compound dispensers 36, each having a different grade of liquid rubbing compound 28. In this way, the buffing process can proceed quickly, even when a change in grade of rubbing compound is required. Wherein a complete side handle assembly 20 is employed to execute a method of buffing a surface that enables a buffing machine operator to simultaneously dispense and apply liquid rubbing compound 36 on a surface 30 while maintaining an uninterrupted grip on a continuously operated buffing machine 22.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

That which is claimed is:

1. A receiving side handle for receiving a liquid rubbing compound dispenser, the receiving side handle being provided for use with hand-held buffing machines of the type having a threaded side handle bore disposed to threadably receive a removable threaded side handle, the receiving side handle being interchangeable with original equipment threaded side handles to enable a buffing machine operator to dispense liquid rubbing compound on a surface while maintaining an uninterrupted grip on a buffing machine so equipped with a receiving side handle, the receiving side handle comprising:

means for releasably engaging a threaded side handle bore of a hand-held buffing machine;

a handle frame attached to the engaging means for mounting the handle frame to a hand-held buffing machine;

a coupling structure defined by a portion of the handle frame for receiving and coupling a liquid compound dispenser to the handle frame;

said handle frame further comprising an elongate tubular shank having:

(1) a first end portion attached to the engaging means for mounting the shank to a hand-held buffing machine;

(2) an opposing second end portion that defines the coupling structure; and (3) a tubular shank body integrally linking the first end portion to the second end portion, wherein the tubular shank body defines a side handle axis; and said tubular shank body includes an opening formed therethrough, transverse to the side handle axis, adjacent the coupling structure, for receiving a portion of a liquid compound dispenser.

2. A receiving side handle as recited in claim 1 wherein the coupling structure comprises a receiving sleeve, the receiving sleeve having a cylindrical inner gripping surface for gripping a liquid compound dispenser.

3. A removable side handle assembly for use with hand-held buffing machines that include a threaded side handle bore disposed to receive a removable threaded side handle, the side handle assembly being interchangeable with original equipment threaded side handles to enable a buffing machine operator to dispense a liquid rubbing compound on a surface while maintaining an uninterrupted grip on the buffing machine, the side handle assembly comprising:

a liquid compound dispenser for dispensing liquid rubbing compounds onto a surface, the liquid compound dispenser having an elongate reservoir for storing liquid rubbing compounds, a finger operated pump mechanism attached to an inlet tube, the inlet tube being in communication with the reservoir, a discharge nozzle operatively connected to the pump mechanism for directing liquid rubbing compounds onto a surface, and a seal cap disposed between the discharge nozzle and the pump mechanism, the seal cap being mountable to the reservoir, wherein a seal cap so mounted secures and seals the pump mechanism to the reservoir;

a receiving side handle that receives the liquid compound dispenser, the receiving side handle being engageable with the threaded side handle bore of a hand-held buffing machine; and the receiving side handle comprising a handle frame attached to a threaded rod, the threaded rod being threadably engagable with the threaded side handle bore of a hand-held buffing machine, wherein a portion of the handle frame defines a coupling structure that receives the seal cap of the liquid compound dispenser.

4. A dispensing side handle assembly as recited in claim 3 wherein a resilient gripping band is attached to the reservoir for gripping by a buffing machine operator.

5. A dispensing side handle assembly as recited in claim 3 wherein the coupling structure comprises a receiving sleeve, the receiving sleeve defining a cylindrical inner gripping surface for gripping the seal cap of the liquid dispenser.

* * * * *